US006320181B1

(12) United States Patent
Noji et al.

(10) Patent No.: US 6,320,181 B1
(45) Date of Patent: Nov. 20, 2001

(54) X-RAY IMAGE TUBE AND MANUFACTURE THEREOF

(75) Inventors: Takashi Noji, Tochigi-ken; Junichi Takahashi; Yuuichi Murakoshi, both of Ohtawara, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/508,522

(22) PCT Filed: Jul. 27, 1999

(86) PCT No.: PCT/JP99/04000

§ 371 Date: May 19, 2000

§ 102(e) Date: May 19, 2000

(87) PCT Pub. No.: WO00/07213

PCT Pub. Date: Feb. 10, 2000

(30) Foreign Application Priority Data

Jul. 27, 1998 (JP) ..... 10-211362

(51) Int. Cl.[7] ..... H01J 40/14

(52) U.S. Cl. ..... 250/214 VT; 313/532; 445/28; 228/110.1

(58) Field of Search ..... 250/214 VT, 207; 313/532, 541, 542, 544; 445/28; 228/110.1, 111, 111.5

(56) References Cited

U.S. PATENT DOCUMENTS 4,423,351 * 12/1983 Sugimori et al. ..... 313/523
5,491,331 * 2/1996 Armentrout ..... 250/214 VT
5,506,403 * 4/1996 Yamada et al. ..... 250/214 VT

* cited by examiner

*Primary Examiner*—David P. Porta
*Assistant Examiner*—Jurie Yun
(74) *Attorney, Agent, or Firm*—Oblon, Spivak, McClelland, Maier & Neustadt, P.C.

(57) ABSTRACT

An X-ray image tube according to the present invention has a whole evacuated envelope comprising an metallic input window through which X-rays pass, a metallic frame to which the metallic input window is welded, a hollow cylinder portion, an output window, etc., and the metallic input window and the metallic frame are hermetically welded to each other by ultrasonic welding. By means of such a construction, an X-ray image tube which can suppress occurrence of distortion of an electronic lens formed in the evacuated envelope, and a manufacturing method thereof is realized.

24 Claims, 7 Drawing Sheets

X-RAY IMAGE TUBE AND MANUFACTURE THEREOF

FIELD OF THE TECHNOLOGY

This invention relates to an X-ray image tube with an X-ray input window arranged at one end of the evacuated envelope permitting X-rays to penetrate, and to a manufacturing method thereof.

BACKGROUND OF THE TECHNOLOGY

An X-ray image tube is an electron tube used for medical diagnosis, etc., which converts X-rays into visible lights, etc. The X-ray image tube is constituted of an evacuated envelope as a whole, and an input window is provided at one end of the evacuated envelope, for example at the side from which X-rays enter. The X-ray input window has a periphery secured to a highly strengthened frame which is hermetically sealed to the hollow cylinder portion of the evacuated envelope. Because the inside of the evacuated envelope needs to be kept highly evacuated, the joined portion of the input window to the frame must be highly hermetic.

For a conventional X-ray image tube, it is known that there is a method of attaching an input window part of titanium or titanium alloy which permits X-rays to penetrate, to a frame part of iron alloy, using spot-resistance-welding by means of an intermediate part intervening between them (Refer to Japanese Patent Disclosure Shou/57-3340).

The structure by the above method makes the input window part be swelled out toward the direction of the inside of the evacuated envelope owing to the pressure difference between the inside and the outside of the evacuated envelope, because the thickness of the X-ray input window of titanium or titanium alloy is, for example, 0.1 mm or below. Consequently an input substrate which is swelled out toward the inverse direction, i.e. toward the outside of the envelope, protruding like a dome and has an input screen stuck thereon must be located in the vicinity of the evacuated region inside the concave input window.

In consequence, the entire length of the evacuated envelope becomes elongated. Furthermore, splashes out of the input window, the frame and the intermediate part caused by the resistance-welding are scattered inside the evacuated envelope. The spattering causes some disadvantages such as deterioration of voltage resisting property or occurrence of spot-like traces in an output image.

Another method where an X-ray input part of aluminum or aluminum alloy and a frame part of iron or iron alloy plated with nickel (Ni) layer on the surface thereof are welded to each other by thermo-compression welding is also known(Refer to Japanese Patent Publication Shou/58-18740).

Referring to FIG. 10 to FIG. 12, an X-ray image tube whose input window part and frame part are welded to each other by thermo-compression welding, and its thermo-compression welding method will be explained.

In FIG. 10, evacuated envelope 101 is constituted of X-ray input window 102 located at one end of the envelope to permit X-rays to pass through, hollow cylinder portion 103 positioned at the center, output window 104 located at the other end of the envelope, etc. Input window 102 is welded to frame 105 of high mechanical strength metal at the periphery thereof and frame 105 is joined to hollow cylinder portion 103. On the inner surface of input window 102 on the evacuated side, input screen 106 converting X-rays into electrons is directly stuck. Inside evacuated envelope 101, a plurality of focusing electrodes 107*a* to 107*c* which accelerate and concentrate electrons emitted out of input screen part 106, and anode 108 are provided. On the evacuated side of output window 104, output screen 109 which converts electrons into predetermined output signals is formed. Mark M denotes the tube axis.

Referring to FIG. 11, welding method of the joined portion of input window 102 to high mechanical strength frame 105 surrounded by the circle A of FIG. 10 will be explained. In FIG. 11, each part corresponding to that in FIG. 10 is denoted by the same mark as that in FIG. 10, and repeated explanations will be partially omitted.

Mark 111 denotes the cylindrical holder of the welding device. Ring shaped frame 105 is put on holder 111. Frame 105 is made of stainless steel, whose cross section is bent like a crank as shown in the figure, and plated with nickel on the surface. Frame 105 is comprised of first flat portion 105*a* at the inside, perpendicular portion 105*b* bent perpendicularly from first flat portion 105*a* and second flat portion 105*c* at the outside. Next, flange portion 102*f* of the periphery of input window 102 is located so as to contact the upper surface of first flat portion 105*a* of frame 105. Input window 102 is made of aluminum(Al) alloy for example, and has domed shape protruding toward the upside of the drawing. Then press punch 112 contacts flange portion 102*f* of the periphery of input window 102 from upside thereof.

Under the construction mentioned above, the pressure of about 1600 kg/cm2 is supplied to the contact region of input window 102 with frame 105 to bond them, while holder 111 and press punch 112 are heated to about 500 degrees centigrade.

The aforementioned thermo-compression welding method is performed under the condition of high temperature and heavy pressure. Therefore, the frame part and the input window part are prone to deform. Especially, because aluminum material which is the material for the input window part flows in large quantity toward both the inner area and the outer area of the pressed region, the input window probably deforms seriously in the vicinity of the joined portion.

Namely in FIG. 12, when the shape of input window 102 before being welded to frame 105 (the shape of the input window under the condition of FIG. 11) is denoted by the dot line D, there is a tendency that input window 102 after thermo-compression welding deforms as the inner region of the joined portion swells like the shape denoted by mark E. This region includes the effective region in which the input screen is formed. Owing to the occurrence of deformation in such region, distortion in an electronic lens formed in the evacuated envelope takes place partially, when the input screen is formed directly on the inner surface of input screen 102.

Moreover, deformation such as wrench often takes place by heating high mechanical strength metal frame 105 to which input window 102 is welded. There is moreover some probability that the above phenomenon makes the deformation of the input window after being welded to each other become remarkable. Namely input window 102 with high precision can hardly be formed by the thermo-compression welding method, so that some contrivance should be required to ameliorate a production yield.

In conventional X-ray image tubes, as explained heretofore, when titanium alloy is used as the input window material, the input window becomes depressed toward the inside of the evacuated envelope, because the thickness of titanium alloy plate is very thin. Therefore the entire outline of the tube becomes bigger, because electrodes must be properly located therein. This causes some difficulty in miniaturizing an X-ray diagnostic apparatus accommodating an X-ray image tube. When aluminum alloy is employed for input window material, the region to be welded is heated to high temperature while the input window and the frame are being welded to each other. Owing to the deformation of the frame and the input window, distortion in the electronic lens formed in the evacuated envelope takes place. Consequently the resolution of the output image deteriorates partially. Therefore further improvement has been expected.

An object of the present invention is to provide an X-ray image tube which can suppress or prevent any deformation of the X-ray input window by adopting the structure where the input window and the frame are hermetically welded to each other by ultrasonic welding to overcome the shortcomings in the conventional technology mentioned above, and a manufacturing method thereof.

DETAILED DESCRIPTION OF THE INVENTION

Figure 1:
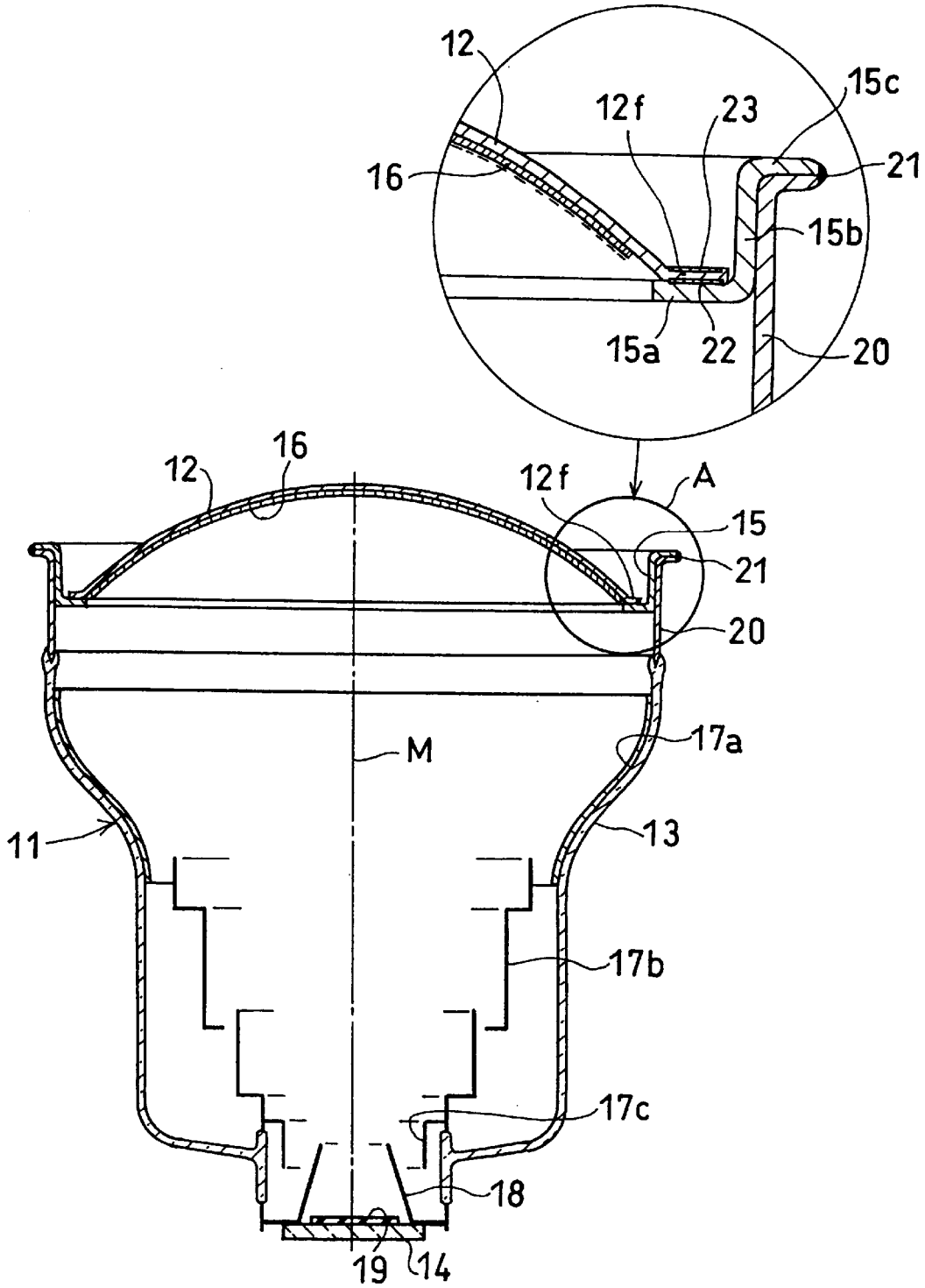
FIG. 1 is a cross section showing an embodiment of this invention.

Referring to FIG. 1, an embodiment of the present invention will be explained. FIG. 1 is a cross section of an X-ray image tube, cut in the direction of tube axis M. Mark 11 denotes an evacuated envelope constituting an X-ray image tube. Evacuated envelope 11 has metallic input window 12 permitting X-rays to penetrate at one end, hollow cylinder portion 13 at the center and output window 14 at the other end.

Metallic input window is made of aluminum(Al) or aluminum alloy. In the case where metallic input window constitutes a part of evacuated envelope 11 to which the atmospheric pressure acts directly like this embodiment, aluminum alloy with high mechanical strength is preferable. The central portion is shaped like a dome swelling out to the atmospheric side, i.e. to the upper side of the figure, and the periphery is formed as flat flange portion 12*f*. The principal parts of hollow cylinder portion 13 and output window 14 are made of glass.

Input window 12 is hermetically welded to metallic frame 15 of high mechanical strength at flange portion 12*f* of the periphery thereof. Frame 15 which is annular as a whole, is made of stainless steel and plated with nickel(Ni).

On the surface of the evacuated side of input window 12, input screen 16 converting X-rays into electrons is directly stuck. Input screen 16 is constituted of a fluorescent material layer consisting of pillar-like crystals of cesium iodide(CsI), a photocathode layer formed thereon, and an optically transparent intermediate layer or a conductive layer intervening between the fluorescent material layer and the photocathode layer, as the occasion demands.

Along hollow cylinder portion 13 of evacuated envelope 11, electrodes through which electrons pass, for example, a plurality of focusing electrodes 17*a* to 17*c* forming an electrostatic lens system, and anode 18 are located coaxially to each other to the tube axis M, in some appropriate order. On the inner surface of output window 14, an output section converting electrons into visible lights or electric output signals, for example, output screen 19 of fluorescent material layers is provided.

In order to keep the inside of evacuated envelope 11 being in high vacuum, the outer periphery of input window 12, e.g. flange portion 12*f* is welded hermetically to a portion of frame 15 of high mechanical strength material by ultrasonic welding. The mark B represents the welded portion by ultrasonic welding. The other end portion of frame 15 is welded hermetically to the flange portion for sealing at the top end of metallic ring 20 of iron alloy for sealing which is secured extending from hollow cylinder portion 13 of evacuated envelope 11. Namely, frame 15 and metallic ring 20 for sealing are hermetically welded to each other at each utmost peripheral edge by arc welding, thus hermetically welded portion 21 is formed.

The welded portion of input window 12 and frame 15 are shown by the magnified diagram of the inside of circle A. Frame 15 is comprised of first flat portion 15*a* at the inside, perpendicular portion 15*b* bent perpendicularly from first flat portion 15*a* and second flat portion 15*c* extending out perpendicularly therefrom. Peripheral flange portion 12*f* of input window 12 is hermetically welded to the upper surface of first flat portion 15*a* of frame 15 at the welded portion by ultrasonic welding. Frame 15 is hermetically welded to the flange portion of metallic ring 20 for sealing which is secured extending from hollow cylinder portion 13.

Input window 12 and frame 15 are welded to each other by ultrasonic welding as mentioned later. Thin plate or foil 22 of aluminum(Al) intervenes between input window 12 and frame 15, and is hermetically sealed with them to improve air-tightness of welded portion. On the upper surface of input window 12, foil or thin plate 23 of copper (Cu) is stuck to prevent input window 12 from adhering to the jig for ultrasonic welding.

Suitable samples of aluminum alloy for making input window 12 are as follows: Aluminum alloys with high mechanical strength standardized as JIS(Japanese Industrial Standard) H4000-1998, e.g. Al—Mn system alloys from No.A3000 to No.A3999, Al—Si system alloys from No.A4000 to No.A4999, Al—Mg system alloys from No.A5000 to No.A5999, Al—Mg—Si system alloys or Al—Mg2-Si system alloys from No.A6000 to No.A6999. As an example of pure aluminum, the material from No.A1000 to No.A1999 standardized by JIS mentioned later is preferable.

A sample of constituents of the above mentioned alloys from No.A3000 to No.A3999 is as follows: not more than 0.6% of Si, not more than 0.8% of Fe, not more than 0.30% of Cu, not more than 1.5% of Mn, not more than 1.3% of Mg, not more than 0.20% of Cr, not more than 0.40% of Zn, not more than 0.15% of inevitable impurity elements, and the remainder of Al in weight %.

Next, a sample of constituents of the above mentioned alloys from No.A5000 to No.A5999 is as follows: not more than 0.4% of Si, not more than 0.7% of Fe, not more than 0.2% of Cu, not more than 1.0% of Mn, not more than 5.0% of Mg, not more than 0.35% of Cr, not more than 0.25% of Zn, not more than 0.15% of inevitable impurity elements, and the remainder of Al in weight %.

Furthermore, a sample of constituents of the above mentioned alloys from No.A6000 to No.A6999 is as follows: 0.4 to 0.8% of Si, not more than 0.7% of Fe, 0.15 to 0.40% of Cu, not more than 1.5% of Mn, 0.8 to 1.2% of Mg, 0.04 to 0.35% of Cr, not more than 0.25% of Zn, not more than 0.15% of inevitable impurity elements, and the remainder of Al in weight %.

Among the above aluminum alloys, for example, the aluminum alloy of JIS-No.A6061 which is a kind of Al—Si—Mg alloys is especially suitable. This is an aluminum alloy which includes about 1.0 weight % of Mg, about 0.6 weight % of Si, about 0.25 weight % of Cu, and about 0.25 weight % of Cr. The quality discrimination mark of the alloy is "O", namely the alloy is an annealed plate.

Figure 2:
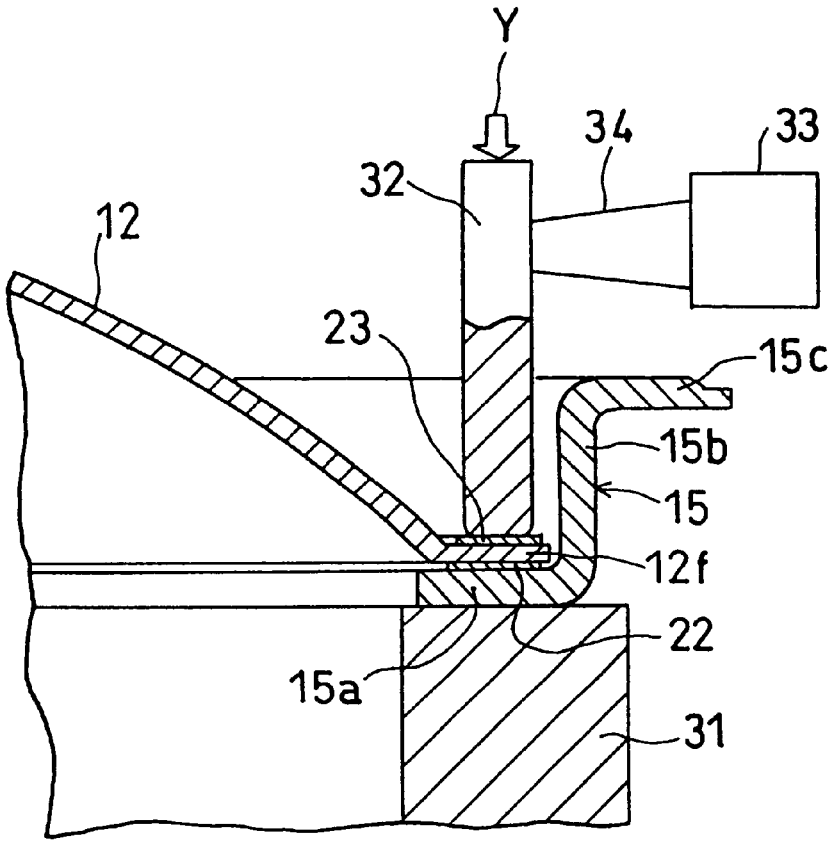
FIG. 2 is a cross section showing a welding method of the input window to the frame according to this invention.

Referring to FIG. 2, a welding method of input window 12 to frame 15 will be explained. FIG. 2 is a figure picking up a part of the welded portion of input window 12 to frame 15. Portions corresponding to those in FIG. 1 are denoted by the same marks as FIG. 1, and repeated explanations will be partly omitted. Mark 31 denotes a cylindrical holder of an ultrasonic welding device. On the upper surface of holder 31, the lower surface of portion 15*a* of frame 15 to be welded is mounted. Next, on the upper surface of portion 15*a* of frame 15 to be welded, peripheral flange 12*f* of input window 12 is mounted.

Between frame 15 and input window 12, thin plate or foil 22 of aluminum(Al) intervenes as an intermediate material. The intermediate material is made of pure Al foil having a thickness of 10 to 50 $\mu$m, preferably 30 $\mu$m, which extends toward the circumferential direction. Because the intermediate material needs to have some functions to improve transmission of ultrasonic wave and degree of contact to both the surfaces to be welded to each other, relatively soft metal is recommended. Therefore, some material which is at least softer than the harder material between frame 15 and input window 12 to be welded by ultrasonic wave is generally preferable for intermediate material 22. By comparing by means of Vickers hardness test, it is preferable to choose some material in which the above relation is realized.

Next, foil or thin plate 23 of copper(Cu) is placed on the upper surface of input window 12, and then press rod 32 is placed on foil or thin plate 23. Cu foil or thin plate 23 has a function preventing press rod 32 from adhering to input window 12 and the thickness thereof is between 10 and 100 $\mu$m, for example 50 $\mu$m. Vibrator horn 34 which propagates the vibration of ultrasonic oscillator 33 contacts to press rod 32.

Under the structure mentioned above, the vibration of ultrasonic oscillator 33 is propagated to the region to be welded via vibrator horn 34 and press rod 32 while a pressure of, for example, 500 kg/cm$^2$ in the direction of the arrow Y is applied by press rod 32 to the region to be welded. Thus the ultrasonic welding is accomplished. The entire periphery is welded by ultrasonic wave, by shifting successively a spot to be welded toward the circumferential direction so that each spot can partly overlap to the neighboring one.

Figure 3:
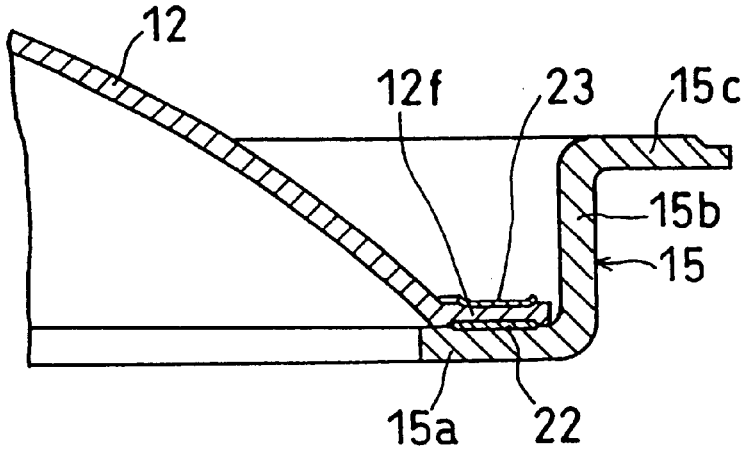
FIG. 3 is a cross section showing the structure of the welding portion of the input window to the frame according to this invention.

FIG. 3 shows the state of input window 12 and frame 15 after ultrasonic-welded by aforementioned method. In FIG. 3, each part corresponding to that in FIG. 2 is denoted by the same mark as that in FIG. 2, and repeated explanations will be partially omitted. By observing the ultrasonic-welded portion B, although any mutually dispersed regions between both materials for the constituents are not broadly recognized at the welded portion in the direction of the depth of the materials, union of metallic atoms which is similar to mutual dispersion of metallic atoms is recognized to exist. Junction of atoms which seems to be due to slight dispersion and recrystallization of the atoms at the interface is recognized to maintain stable hermetic welding over the entire periphery. Any undesirable splash also does not take place.

Figure 4:
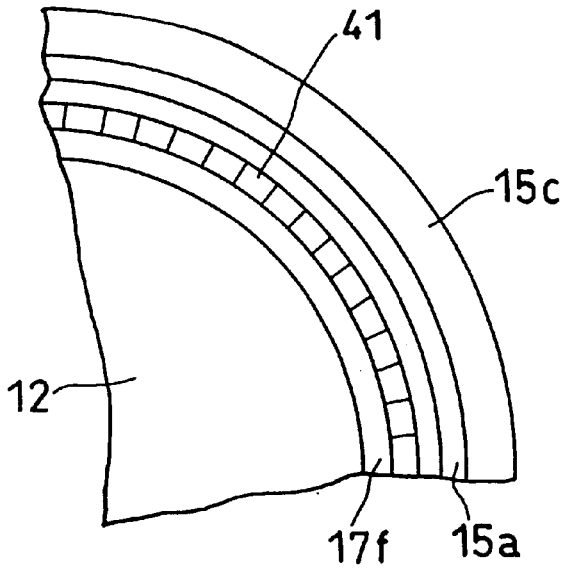
FIG. 4 is a front view showing a consecutive form of welding spots according to this invention.

FIG. 4 shows the state of the welded spots of input window 12 and frame 15 seen from the upside. In FIG. 4, each part corresponding to that in FIG. 2 is denoted by the same mark as that in FIG. 2, and repeated explanations will be partially omitted.

FIG. 4 is a diagram of input window 12 seen from the direction in which X-rays enter. Spot-compression welded spots by ultrasonic welding are shaped rectangular or elliptic by compression as denoted by mark 41, and neighboring welded spots are contacted to each other. Spot-compression welded spots 41 like this are formed continuously over the entire periphery of peripheral flange 12*f* of input window 12. By making each spot-compression welded spot 41 by ultrasonic welding overlapped partly with the neighboring one, air-tightness and mechanical strength of the welded portion are further improved.

As a consequence of ultrasonic welding, a difference in level takes place at each joined portion between neighboring spot-compression welded spots or at the end of the input window in the radial direction at each spot-compression welded spot. In the case where the thickness of the input window is for example 0.8 mm, the dent owing to the difference in level is about 0.2 to 0.3 mm. Due to the above, shearing may take place in the vicinity of the compressed portion of the input window which is compressed when the welding is carried out. In this case, the shearing of the input window is prevented by forming a slope at the edge of the end of the press rod which contacts and compresses flange portion 12*f* of the input window or by making the edge portion round. When the press rod having the shape mentioned above is utilized, the edges of the spot-compression welded spots in the radial direction take the shape of transcription of the slope or the round portion.

Figure 5:
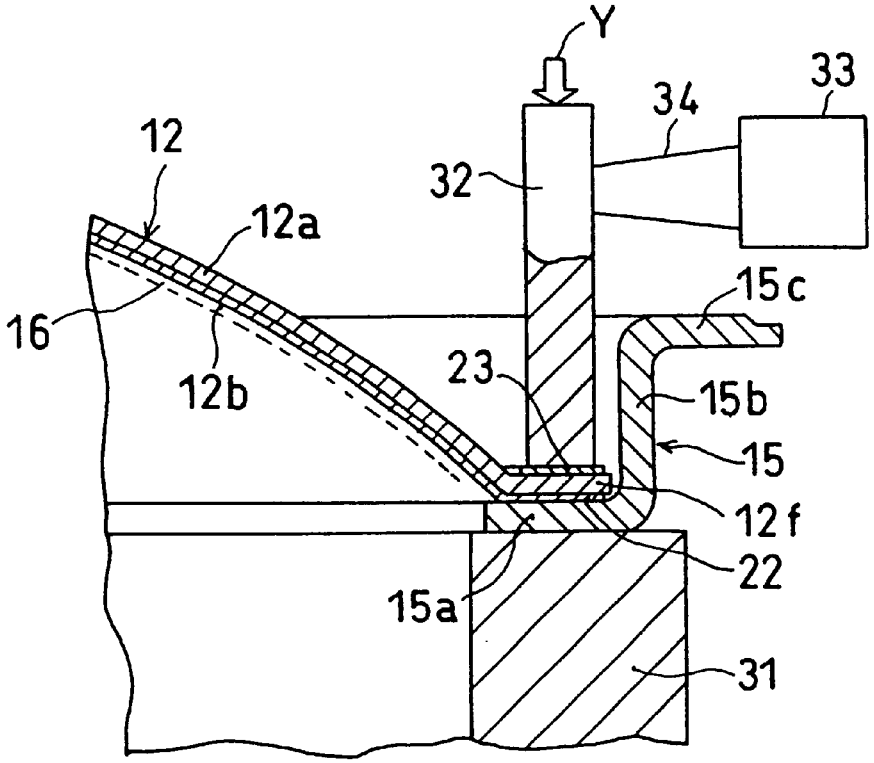
FIG. 5 is a cross section showing another welding method of the input window to the frame according to this invention.

Next, referring to FIG. 5, another embodiment of the present invention will be explained. In FIG. 5, each part corresponding to that in FIG. 2 is denoted by the same mark as that in FIG. 2, and repeated explanations will be partially omitted.

In the embodiment shown in FIG. 5, input window 12 is constituted of unified clad plate which has high strength aluminum alloy material 12*a* on the side of the atmosphere i.e. the outside, and pure aluminum material 12*b* on the side of evacuated region i.e. the inside. On pure aluminum material 12*b* of the inside of input window 12, the input part, namely input screen 16 which converts incident X-rays into a fluorescent image and then a photoelectron image is directly stuck.

In this case, pure aluminum material 12*b* is employed as the intermediate material intervening between flat portion 15*a* of the frame and peripheral flange portion 12*f* of the input window, just as it is. However, Al foil can be placed as the intermediate material in particular. Mark 16 denotes the input screen stuck directly on the surface of the evacuated side of input window 12, after input window 12 and frame 15 have been put to each other by ultrasonic welding.

For X-ray input window 12 of aluminum clad like the above, high mechanical strength aluminum alloy material 12*a* such as Al—Mn system alloys from No. A3000 to No.A3999, Al—Si system alloys from No.A4000 to No.A4999, Al—Mg system alloys from No.A5000 to No.A5999, Al—Mg—Si system alloys or Al—Mg2-Si system alloys from No.A6000 to No.A6999, etc. standardized as JIS is employed.

For the specific example of pure aluminum material 12*b* of the input window, aluminum plate from No.A1000 to No.A1999 (purity equal to or more than 99.0%) standardized as JIS, especially A1050P material (purity equal to or more than 99.5%) is suitable. An example of constituents of the above mentioned No.A1000 to No.A1999 is as follows: not more than 0.25% of Si, not more than 0.4% of Fe, not more than 0.05% of Cu, not more than 0.05% of Mn, not more than 0.05% of Mg, not more than 0.10% of Zn, not more than 0.15% of inevitable impurity elements in weight %.

If the thickness of the Al clad plate constituting the input substrate which also functions as an input window of an evacuated envelope is less than 0.3 mm, pressure resistant strength as an evacuated envelope is insufficient. On the other hand, if the thickness is more than 3.0 mm, it is difficult that high quality radiographs with high contrast and high resolution can be obtained because of increase in permeation loss or dispersion of the radiation. Therefore it is suitable that the total thickness of the Al clad plate constituting the input substrate which also functions as an input window of an evacuated envelope is in the range between 0.3 mm and 3.0 mm.

The ratio of the thickness of high purity aluminum alloy material to the thickness of pure aluminum material constituting the Al clad plate is in 1:2 to 80:1 preferably 2:1 to 5:1.

Figure 6:
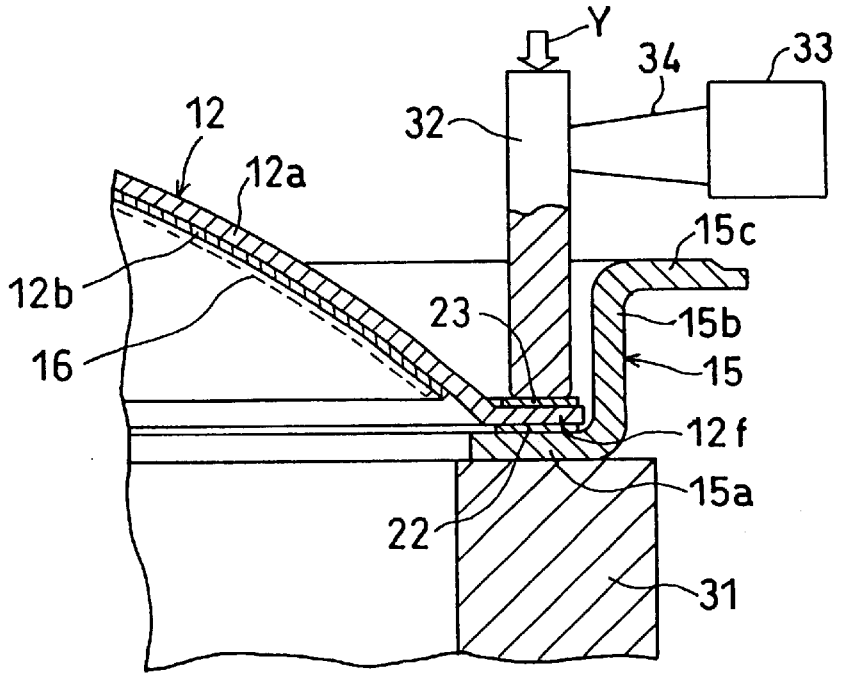
FIG. 6 is a cross section showing another welding method of the input window to the frame according to this invention.

Next, referring to FIG. 6, another embodiment of the present invention will be explained. In FIG. 6, each part corresponding to that in FIG. 2 is denoted by the same mark as that in FIG. 2, and repeated explanations will be partially omitted.

In this embodiment, input window 12 is constituted of unified clad plate which has high mechanical strength aluminum alloy material 12*a* on the side of the atmosphere i.e. the outside, and pure aluminum material 12*b* on the side of evacuated region i.e. the inside. At the peripheral edge of input window 12, pure aluminum material 12*b* is partly removed, so flat flange portion 12*f* is constituted of solely high mechanical strength aluminum alloy material 12*a*.

As shown in FIG. 6, pure aluminum material 12*b* of input window 12 may be removed at the outer peripheral portion including the region to be welded, or pure aluminum material 12*b* having only a certain width located inside the region to be welded may also be partly removed instead, while having pure aluminum material 12*b* at the region to be welded remained. Furthermore, whether pure aluminum material 12*b* is removed or not, ultrasonic welding may be carried out by means of another Al foil intervening between frame 15 and the outer flange portion of the input window.

Figure 7:
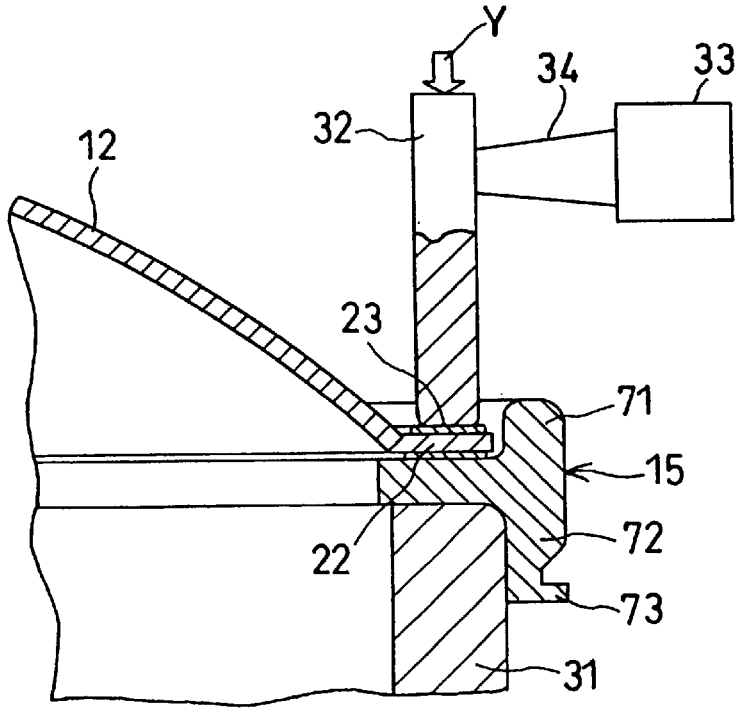
FIG. 7 is a cross section showing another welding method of the input window to the frame according to this invention.

Next, referring to FIG. 7, another embodiment of the present invention will be explained. In FIG. 7, each part corresponding to that in FIG. 2 is denoted by the same mark as that in FIG. 2, and repeated explanations will be partially omitted.

In this embodiment, input window 12 is made of high mechanical strength aluminum alloy, and frame 15 is made of Al or Al alloy. The thickness of frame 15 is greater than that in the case of iron alloy employed, in order to improve mechanical strength. Frame 15 is constituted of first annular protrusion 71 projecting toward input window 12 and second annular protrusion 72 projecting toward the inverse direction to the above, and thin portion 73 for welding (hard soldering or welding) to other portions is provided at the end of second protrusion 72.

Figure 8A:
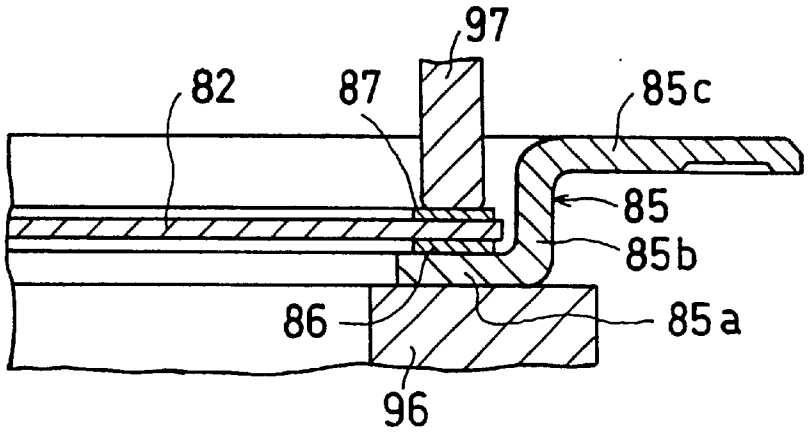
FIG. 8 is a cross section showing an embodiment in which this invention is applied to a flat panel type X-ray image tube, (a) is a cross section showing another welding method of the input window to the frame, (b) is a cross section of a flat panel type X-ray image tube partially cut.
Figure 8B:
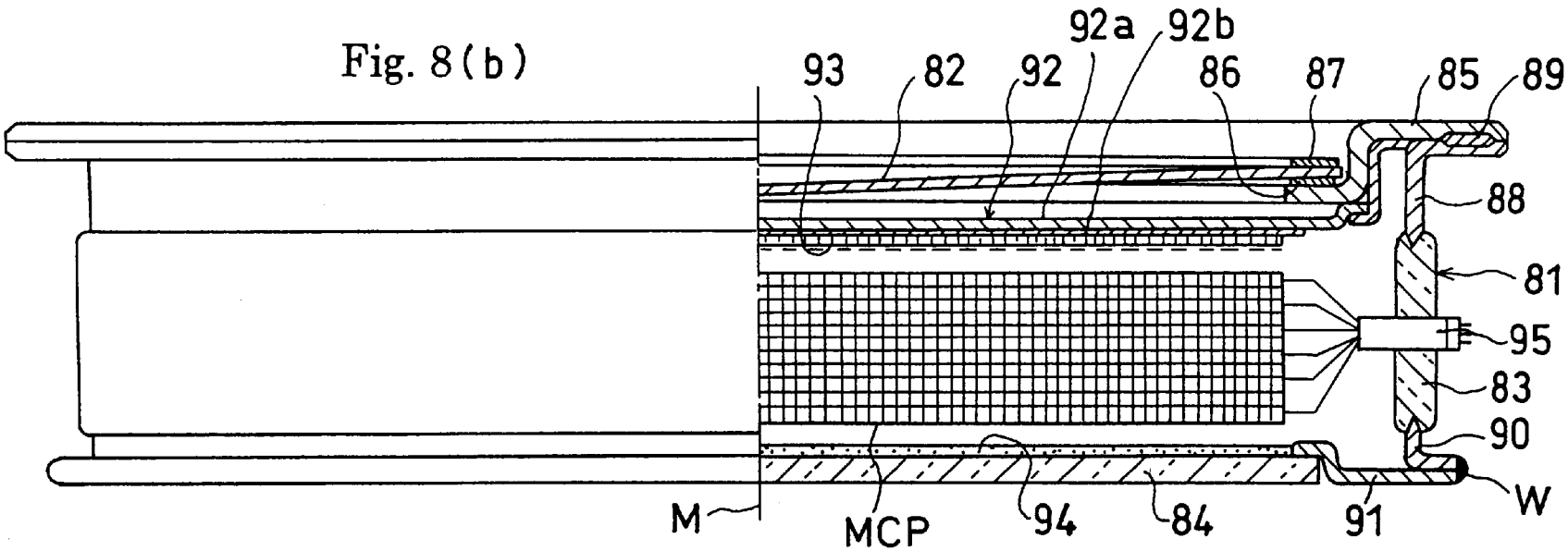

Next, referring to FIG. 8, another embodiment of the present invention will be explained about the case in which the invention is applied to a flat panel type X ray image tube utilizing a micro-channel plate. FIG. 8(*a*) shows the welding method of an X-ray input window to a frame, and FIG. 8(*b*) shows a flat panel type image tube, which is cut away at the right half to tube axis.

Mark 81 denotes an evacuated envelope which forms a flat panel type X-ray image tube. Evacuated envelope 81 is comprised of substantially panel-shaped input window 82, cylindrical glass insulating container 83, substantially panel-shaped output window 84, etc. When input window 82 is formed like a flat panel using aluminum alloy, the completed flat panel type X-ray image tube has input window 82 slightly dented toward the inside of the tube due to the influence of the atmospheric pressure as shown in FIG. 8(*b*). However, input window 82 can be formed swelling out to the atmospheric side like a dome. In this case, a flat panel type X-ray image tube where the input window 82 practically keeps the dome-shape can be constructed.

The peripheral portion of input window 82 is welded to high mechanical strength frame 85 by ultrasonic wave like the embodiment mentioned above. Between input window 82 and metal frame 85, Al foil 86 used as the intermediate material sticks, and foil or thin plate 87 of copper(Cu) preventing the jig for ultrasonic welding from sticking to input window 82 sticks on the upper surface of input window 82.

Incidentally, in this embodiment, the outer peripheral portion of metal frame 85 and annular sealing flange 88 of metal extending from one end of glass insulating container 83 are hermetically sealed together by hermetic welding with indium(In) which intervenes between them. Metal frame 85 and sealing flange 88 are made of iron alloy such as stainless steel or Kovar(trade name). Nickel(Ni) plating of, for example 10 to 50 $\mu$m in thickness is formed in advance on the surfaces of these parts, as mentioned later. As the occasion demands, these parts are heated in vacuum in order to make the wetting or the adhesion with indium 89 favorable.

Annular sealing flange 90 of iron alloy extending from the other end of glass insulating container 83 and metallic anode ring 91 to which output window 84 is hermetically welded at the inner periphery thereof are hermetically welded to each other at the hermetic welding portion W over the whole periphery thereof. Anode ring 91 is electrically connected with the metal back film of output screen 94 formed on the inner surface of output window 84.

Inside evacuated envelope 81, planar input substrate 92 made of pure aluminum or aluminum clad is located adjacent and facing to input window 82, and input screen 93 is stuck on input substrate 92. When input substrate 92 is made of Al clad, the upper surface in the figure, i.e. the outside is high mechanical strength aluminum alloy material 92*a,* and the lower surface in the figure, i.e. the inside is pure aluminum material 92*b* on which input screen 93 is stuck. Because input substrate 92 is located in vacuum where the atmospheric pressure does not exist, any bending and local deformation do not take place. Especially, by forming input substrate 92 with aluminum clad material, bending and local deformation are much more prevented.

Input substrate 92 is fixed to metal frame 85 via holder 92*c*. Facing to input screen 93, an electrode through which electrons pass, for example a micro-channel plate MCP having a great number of channels to multiply electrons is positioned. Facing to the micro channel plate MCP, output screen 94 is formed securely on the inner surface of output window 84.

Piercing glass insulating container 83 hermetically, electric terminal 95 to control the action of the micro channel plate MCP is provided.

Then, a manufacturing method of the flat panel type X-ray image tube having the structure mentioned above will be explained. In the structure shown in FIG. 8(*a*), the peripheral portion of input window 82 and frame 85 of stainless steel plated with nickel by, for example, 50 $\mu$m of thickness in advance are welded to each other by ultrasonic welding. Frame 85 is comprised of first flat portion 85*a* at the inside thereof, perpendicular portion 85*b* bent perpendicularly from first flat portion 85*a,* and second flat portion 85*c* at the outside thereof. First flat portion 85 is located on holder 96. Next, the peripheral portion of input window 82 is located on first flat portion 85*a* of frame 85.

In this case, like the same manner as aforementioned embodiment, Al foil or thin plate 86 as an intermediate material intervenes between frame 85 and input window 82. The intermediate material has functions to improve the transmission of ultrasonic wave to the surface to be welded and to increase air-tightness of welded portion. As for intermediate material, some materials softer than the harder material between frame 85 and input window 82 are preferable, as explained in the embodiment mentioned before. Foil or thin plate 87 of copper(cu) is placed on the upper surface of the periphery of input window 82, and then press rod 97 is placed on foil or thin plate of copper(Cu). Foil or thin plate 87 of copper(Cu) is to prevent press rod 97 from sticking to input window 82, like the embodiment mentioned above.

In the same way as FIG. 2, a vibrator horn which propagates the vibration of ultrasonic oscillator contacts to press rod 97, though it is not shown in this figure. The peripheral portion of input window 82 and frame 85 are welded to each other by ultrasonic welding, transmitting a vibration of the ultrasonic oscillator to the region to be welded via the vibrator horn, while compressing the region to be welded with the press rod.

The outer periphery of input window 92 made of a flat plate of pure aluminum or aluminum clad is mechanically fixed and electrically connected to metal frame 85 which has welded input window 82 with holder 92*c*. The assembled structure of input substrate 92 located adjacent to the inside of input window 82 which is unified with metal frame 85 and holder 92*c,* is placed in the vapor deposition apparatus which is not shown in the figure, and then the fluorescent layer of input screen 93 is directly deposited onto the surface of pure Al layer 92*b* inside input substrate 92 by vapor deposition.

On the other hand, the micro channel plate MCP is placed at the predetermined position inside the remaining room of the evacuated envelope, and output window 84 having formed output screen 94 thereon, metallic anode ring 91, sealing flange 90, etc. are put together and hermetically welded at the soldering portion W. On flat portion 88*a* of sealing flange 88 positioned at the opening periphery of the evacuated container portion, nickel plating of for example 30 $\mu$m in thickness is done on the surface thereof in advance.

Then, in a vacuum tank to form a photocathode of the input screen, the first assembled structure in which input window 82, metal frame 85 and input substrate 92 having formed a fluorescent layer of input screen thereon are put together, and the second assembled structure in which the micro channel plate MCP and the output window, etc. are put together, are placed appropriately apart from each other. Under the condition, an indium ring in an appropriate shape and thickness is set in a circumferential dent formed on the upper surface of flat portion 88*a* of sealing flange 88.

Next, an evaporating source crucible containing materials for forming the photocathode is placed at a predetermined position facing to the fluorescent layer of the input screen, and then photocathodic layer 93*a* is formed on the surface of fluorescent layer 93, by evaporating photocathodic materials toward the fluorescent layer. An appropriate masking measure to prevent evaporated photocathodic materials from dispersing and depositing undesirably on the other portion should naturally be performed.

After the photocathode has been formed on the fluorescent layer of the input screen in this manner, the evaporating source of photocathodic materials and the masking measure, etc. are shifted and removed from the first combined structure and the second combined structure, and then both the combined structures are set closely, with the inside of the vacuum tank kept in vacuum state. Then, in the vicinity of the outer periphery of flat portion 88*a* of sealing flange 88 holding indium ring 89, a heating measure, for example, an electric heater is placed so as to surround the whole periphery of flat portion 88*a*. Next, flat portion 88*a* of the sealing flange, indium ring 89 held thereon, and outer flat portion 85*c* of the metal frame are mainly heated by the electric heater being supplied with electricity. On this occasion, it is desirable that paying attention not to heat up the other portions such as the input window, the input screen, the micro channel plate MCP, the output screen, etc. to undesirable temperature.

In this manner, flat portion 88*a* of sealing flange 88 on which indium ring 89 is placed, and the lower surface with a dent on outer flat portion 85*c* of metal flame 85 at the input window are put together face-to-face in the vacuum tank using appropriate jigs and tools. Because indium ring 89 intervenes between both flat portions, hermetic sealing is carried out by indium ring 89 squashed with an appropriate pressure.

The melting point of indium(In) is about 156° C. Therefore, while the flat portions which are to be welded to indium ring 89 are heated to, for example, 100° C. or over, preferably to a temperature higher than the melting point, e.g. about 200° C., hermetic sealing can be carried out with little or a relatively slight compression. However, it is needless to say that heating should be performed below the temperature at which neither the input screen nor the micro channel plate MCP can maintain its property.

Both the outer flat portions of metal frame 85 and sealing flange 88 which are welded to each other with intervention of the indium are not necessarily heated to the same temperature. For instance, by the method where indium ring is placed in advance, namely under the condition where the outer flat portion of sealing flange 88 is heated to the temperature mentioned above, and metal frame 85 is kept in a temperature much lower than the above temperature, both the flat portions are put together face-to-face, and then may be welded with the indium intervening between them.

If welding is performed in a temperature higher than the melting point of indium, a circumferential dent or other flow-out-preventing measure must be provided on the outer flat portion of sealing flange 88 positioned at the lower side, in order that liquid state indium neither moves nor flows out from the region to be welded.

Because nickel plated layers have been formed in advance on the surfaces of both flat portions 85*c,* 88*a* which hold indium ring 89 between them, favorable wetting-contact and highly reliable hermetic welding state can be accomplished. Although relatively heavy compression is required, hermetic welding with intervention of indium is also possible even in the normal temperature (for example 0° C. to 30° C.).

According to the manufacturing method mentioned above, an X-ray image tube wherein the inside of the hermetic-sealed envelope is kept in vacuum state as it is, can be completed. Furthermore, because it is not necessary that the photocathode, etc. should be exposed to the atmosphere after being formed, the properties of the photocathode, etc. do not deteriorate.

In the aforementioned flat panel type X ray image tube, X-rays enter through input window 82 and are converted into photoelectrons at input screen 93. Then they are multiplied by the micro channel plate MCP and converted into visible lights and finally come out as output images at output window 84. The output section can also have a structure which outputs electrical video output signals, if necessary.

Figure 9:
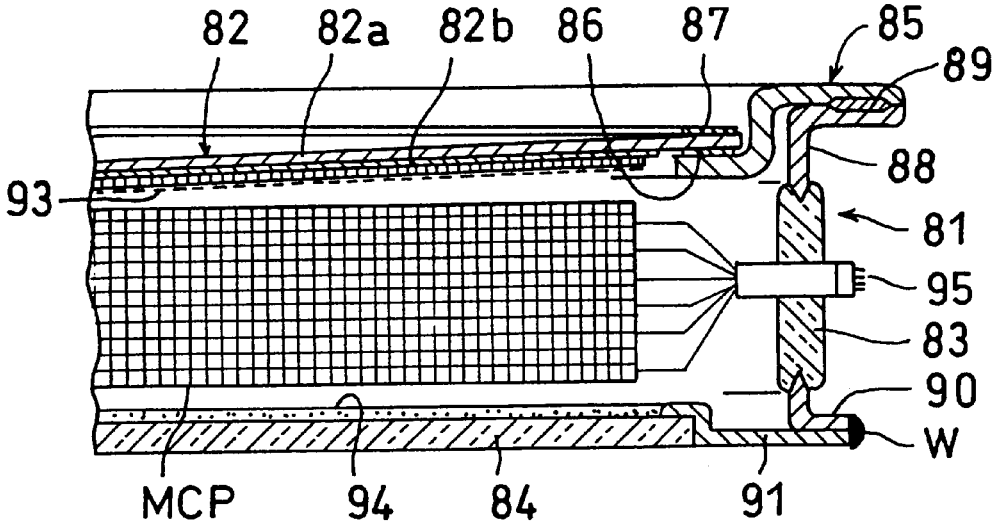
FIG. 9 is a cross section showing another embodiment in which this invention is applied to a flat panel type X-ray image tube.
Figure 10:
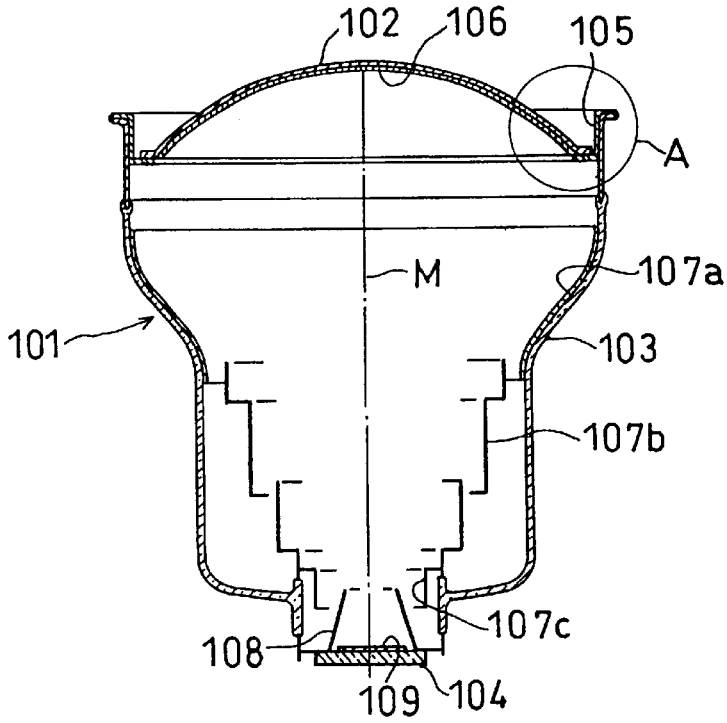
Fig. 10 (prior art)
FIG. 10 is a cross section showing the conventional example.
Figure 11:
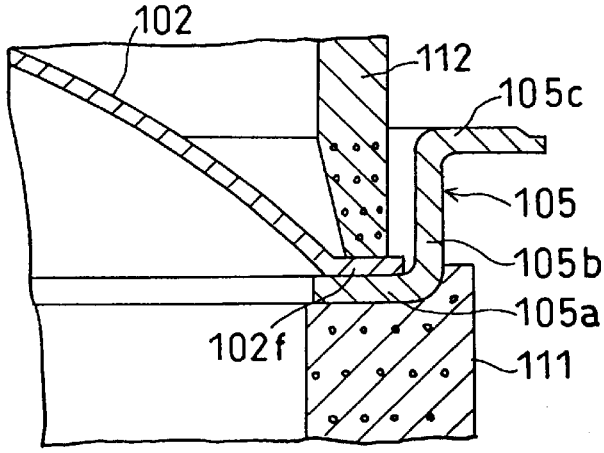
Fig. 11 (prior art)
FIG. 11 is a cross section showing a welding method of the input window to the frame according to the conventional example.
Figure 12:
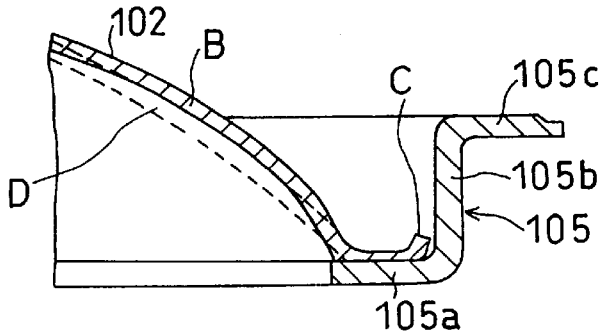
Fig. 12 (prior art)
FIG. 12 is a cross section showing a structure of welding portion of the input window to the frame according to the conventional example.

Next, another embodiment of the present invention will be explained about the case in which the invention is applied to a flat panel type X ray image tube utilizing a micro-channel plate, referring to FIG. 9 which shows a portion of the embodiment. In FIG. 9, each part corresponding to that in FIG. 8 is denoted by the same mark as that in FIG. 8, and repeated explanations will be partially omitted.

In this embodiment, input window 82 is constituted of a unified clad plate which has high mechanical strength aluminum alloy material 82*a* on the side of the atmosphere i.e. the outside, and pure aluminum material 82*b* on the side of evacuated region i.e. the inside. Input screen 93 is directly formed on the inner surface of pure aluminum material 82*b* of input window 82. Although input window 82 is formed like a flat panel, it dents to some extent toward the inside of the tube due to the influence of the atmospheric pressure as shown in the figure.

In such a case, it is also possible to mitigate or dissolve any distortions of an image caused by the dent of the input window, by placing closely a micro channel plate MCP having an appropriate shape and arrangement corresponding to the dent of input window 82. Moreover, the input window can have a structure protruding like a dome toward the atmospheric side as it has been mentioned above.

In every embodiment mentioned heretofore, when the input window of aluminum or aluminum alloy and the high mechanical strength frame of stainless steel or aluminum are welded to each other by ultrasonic wave, the portions to be welded of the input window and the frame are put together, and then the portions to be welded are placed between the holder and the press rod. Then, the input window and the frame are welded to each other by an ultrasonic vibration being supplied to the portion to be welded, where the input window and the frame are put together, under the condition that an appropriate pressure between 100 and 800 kg/cm$^2$ (e.g. about 500 kg/cm$^2$) is supplied to the portion to be welded, at a temperature of 100° C. or below, preferably the normal temperature (e.g. 0° C. to 30° C.). Thus, any deformation of the input window within the effective region of the X-ray radiograph can be prevented before it happens.

According to the constructions mentioned above, aluminum or aluminum alloy is used as the material for the input window. Accordingly, the input window does not dent on a large scale toward the inside of the evacuated envelope. This leads to miniaturizing the X-ray image tube. When the material of the input window is welded to the material of the frame, both the portions to be welded are pressed. However the welding is carried out in the temperature of 100° C. or below, for example in the range between −20° C. to 100° C., preferably in the normal temperature (0° C. to 30° C.) which does not require particularly any control of the environmental temperature. Because aluminum does not deform at any temperature below 100° C., it is welded to the frame without the parts of the input window deformed. Therefore, the distortion of the electron lens in the evacuated envelope can be removed or diminished to a negligible degree so that a high quality output image can be obtained.

Although an aluminum alloy plate is employed as the input window parts, if the input diameter is large such as an X-ray image tube employing a micro channel plate, etc., the input window might dent toward the inside of the evacuated envelope owing to the pressure difference between the vacuum and the atmosphere. In such a case, if stainless steel of 0.05 to 0.2 mm in thickness is employed instead of aluminum, the degree of the dent can decrease. When stainless steel is employed, an input window of thin stainless steel and a high mechanical strength thick frame can be welded to each other by ultrasonic welding in the same manner as aluminum employed. For instance, if a stainless steel sheet such as SUS316 of JIS Standard is employed for the input window parts, deformation of the input window due to pressing decreases and reliability of hermetic welding increases. Moreover, any splashes owing to ultrasonic welding do not take place.

According to the above-mentioned construction, a structure where a fluorescent surface is formed on the inner surface or inside of the input window of the X-ray image tube can be constructed with, for example, a sheet of aluminum plate.

Therefore, an X-ray image tube which has a low X-ray absorbing ratio and an excellent contrast can be realized. Furthermore, because a photocathode of uniform shape can be formed, little aberration takes place and clearness of the image is improved, and then MTF characteristics can also be made better. A flat input window can be easily constructed and the total length of the evacuated envelope can be shortened, and then miniaturization of the tube is also easily achieved.

According to the present invention, an X-ray image tube which can suppress occurrence of distortion of an electron lens before it happens, and manufacturing methods thereof are realized.

What is claimed is:

1. An X-ray image tube comprising:

an evacuated envelope comprising, a metallic input window allowing penetrating X-rays, a metallic frame hermetically sealed with the metallic input window at a peripheral portion of the metallic input window by means of ultrasonic welding;

an input screen located directly to the inner surface of the metallic input window or closely thereto of being fixed to another substrate, converting the X-rays into electrons, an electron-passing-through electrode permitting the electrons emitted out of the input screen to pass through, and an output screen obtaining an optical or electrical output signal in compliance with receiving the electrons coming via the electron-passing-through electrode.

2. The X-ray image tube as stated in claim 1, wherein the electron-passing-through electrode is an electron-multiplying micro channel plate.

3. The X-ray image tube as stated in claim 1, wherein a thin plate or a foil of a material whose hardness is smaller than the hardness of the material being the larger one between the peripheral portion of the metallic input window and the frame in hardness, intervenes between the peripheral portion of the metallic input window and the frame, and the peripheral portion, the frame and the thin plate or the foil are welded together by ultrasonic welding.

4. The X-ray image tube as stated in claim 3, wherein the peripheral portion of the metallic input window is made of pure aluminum or aluminum alloy, the frame is made of iron or iron alloy or iron covered with nickel or iron alloy covered with nickel, and the thin plate or foil intervening between the peripheral portion of the metallic input window and the frame is made of pure aluminum or aluminum alloy.

5. The X-ray image tube as stated in claim 3, wherein the peripheral portion of the metallic input window is made of pure aluminum or aluminum alloy, the frame is made of aluminum alloy, and the thin plate or foil intervening between the peripheral portion of the metallic input window and the frame is made of pure aluminum.

6. The X-ray image tube as stated in claim 1, wherein the ultrasonic welding is formed over the entire periphery of the peripheral portion of the metallic input window, in such a manner that neighboring spot-like welded spots are partially overlapped with one another.

7. The X-ray image tube as stated in claim 1, wherein the peripheral portion of the metallic input window is made of pure aluminum or aluminum alloy, and a thin plate or a foil of copper or copper alloy is adhered on the surface at back side of the portion of the metallic input window welded to the frame, in unification with the peripheral portion.

8. The X-ray image tube as stated in claim 1, wherein the metallic input window is made of aluminum alloy in the atmospheric side and of clad plate of pure aluminum in the rear side.

9. The X-ray image tube as stated in claim 1, wherein the metallic input window is made of aluminum alloy in the atmospheric side and of clad plate of pure aluminum in the rear side, and the pure aluminum layer in the rear side of the peripheral portion of the metallic input window which is made of the clad plate acts simultaneously as a thin plate or a foil intervening between the peripheral portion of the metallic input window and the frame.

10. The X-ray image tube as stated in claim 1, wherein the metallic input window is made of aluminum alloy in the atmospheric side and of clad plate of pure aluminum in the rear side, and the thickness of the clad plate is in the range between 0.3 and 3.0 mm.

11. The X-ray image tube as stated in claim 1, wherein the metallic input window is made of aluminum alloy in the atmospheric side and of clad plate of pure aluminum in the rear side, the ratio of the thickness of the aluminum alloy to the thickness of the pure aluminum constituting the clad plate is in the range from 1:2 to 80:1.

12. The X-ray image tube as stated in claim 1, wherein the metallic input window is made of stainless steel.

13. The X-ray image tube as stated in claim 1, wherein a metallic sealing flange is further provided on the remaining portion apart from the metallic input window of the evacuated envelope, and is hermetically welded by means of indium intervening between the metallic frame welded to the metallic input window by ultrasonic wave and the metallic sealing flange.

14. The X-ray image tube as stated in claim 13, wherein a nickel layer covers at least the surfaces contacting the indium of the metallic frame and the metallic sealing flange.

15. A manufacturing method of an X-ray image tube comprising, an evacuated envelope containing a metallic input window allowing penetrating X-rays and a metallic frame hermetically sealed with a peripheral portion of the metallic input window, an input screen located directly to the inner surface of the metallic input window of the evacuated envelope or closely thereto being fixed to a substrate, converting the X-rays into electrons, an electron-passing-through electrode permitting the electrons emitted out of the input screen to pass through, and an output screen obtaining an optical or electrical output signal in compliance with receiving the electrons coming via the electron-passing-through electrode, wherein the hermetically sealing of the peripheral portion of the metallic input window to the metallic frame is carried out by means of ultrasonic welding.

16. The manufacturing method of the X-ray image tube as stated in claim 15, wherein pure aluminum or aluminum alloy or stainless steel is employed as the metallic input window.

17. The manufacturing method of the X-ray image tube as stated in claim 15, wherein iron, iron covered with nickel layer, iron alloy, iron alloy covered with nickel, pure aluminum or aluminum alloy is employed as at least a portion to be welded by ultrasonic welding of the metallic frame.

18. The manufacturing method of the X-ray image tube as stated in claim 15, wherein the peripheral portion of the metallic input window and the metallic frame are piled up to each other and placed between a holder and a press rod for ultrasonic welding, and then the peripheral portion of the metallic input window and the frame are hermetically welded to each other by ultrasonic welding by an ultrasonic vibration supplied thereto, while a pressure of 100 to 800 kg/cm2 is supplied between the holder and the press rod for ultrasonic welding.

19. The manufacturing method of the X-ray image tube as stated in claim 15, wherein the hermetic welding by ultrasonic wave is carried out in a temperature environment of 100° C. or below.

20. The manufacturing method of the X-ray image tube as stated in claim 15, wherein the hermetic welding by ultrasonic wave is carried out with a thin plate or a foil of pure aluminum or aluminum alloy intervening between the peripheral portion of the metallic input window and the frame.

21. The manufacturing method of the X-ray image tube as stated in claim 15, wherein the hermetic welding by ultrasonic wave is carried out with a thin plate or a foil of copper or copper alloy intervening between the portion to be pressed on the back surface of the welded portion of the metallic input window to the frame and the press rod for ultrasonic welding.

22. The manufacturing method of the X-ray image tube as stated in claim 15, wherein a metallic sealing flange is further provided on the remaining portion apart from the metallic input window of the evacuated envelope, and hermetically welded by indium intervening between the metallic frame which is welded to the metallic input window by ultrasonic wave and the metallic sealing flange.

23. The manufacturing method of the X-ray image tube as stated in claim 15, wherein a nickel layer covers the surfaces of the metallic frame and the metallic sealing flange in advance.

24. The manufacturing method of the X-ray image tube as stated in claim 22, wherein a temperature of the portion to be welded with indium intervening between the metallic frame and the metallic sealing flange is in the range between 0° C. and 200° C.

* * * * *